United States Patent [19]

Lepper et al.

[11] 4,262,191

[45] Apr. 14, 1981

[54] DIGITAL ELECTRONIC STEAM HUMIDIFIER CONTROL

[75] Inventors: James M. Lepper, Redlands, Calif.; John C. McNabney; James A. Haas, both of Verona, Wis.

[73] Assignee: Wehr Corporation, Milwaukee, Wis.

[21] Appl. No.: 24,701

[22] Filed: Mar. 28, 1979

[51] Int. Cl.[3] ..... H05B 1/02; H05B 3/60

[52] U.S. Cl. ..... 219/497; 219/295; 219/286; 219/272; 219/518; 236/44 C; 236/44 A

[58] Field of Search ..... 219/295, 286, 283, 287, 219/272, 273, 497, 499, 492, 494, 508, 509; 236/44 R, 44 E, 44 C, 44 A; 361/251

[56] References Cited

U.S. PATENT DOCUMENTS

| | | | |
|---|---|---|---|
| 2,453,210 | 11/1948 | Eaton | 219/286 |
| 3,682,141 | 8/1972 | Johansen | 219/295 |
| 3,937,920 | 2/1976 | Gundacker et al. | 219/295 |
| 3,944,785 | 3/1976 | Ewton-Williams | 219/295 |
| 4,024,440 | 5/1977 | Miller | 361/251 |
| 4,093,847 | 6/1978 | Walker et al. | 219/295 |
| 4,139,762 | 2/1979 | Pohrer et al. | 219/272 |
| 4,146,775 | 3/1979 | Kirchner et al. | 219/295 |

FOREIGN PATENT DOCUMENTS

| | | | |
|---|---|---|---|
| 2443136 | 3/1975 | Fed. Rep. of Germany | 219/295 |

*Primary Examiner*—B. A. Reynolds

*Assistant Examiner*—M. Paschall

[57] ABSTRACT

Disclosed herein is a method and a digital electronic steam humidifier control for use with a humidifier system including an electrode boiler to provide a normally repetitive fill, boil, fill-on-drain cycle. The humidifier control includes circuitry for providing an analog signal proportional to the electrode current, and a comparator network which receives the analog signal and a reference voltage and scaled voltages provided by additional circuitry to establish predetermined levels of electrode current at which the control responds. The comparator network provides a plurality of digital outputs having a high or low state depending upon the magnitude of the electrode current, which outputs are coupled to logic circuitry including NAND gates and which operates to actuate electrically controlled fill and drain valves to vary the water level so that the electrode current varies between predetermined lower and upper current limits, and which also operates to temporarily cut off the power to the electrodes if the electrode current exceeds a predetermined over-current limit. The logic circuitry also operates in conjunction with high water probes to prevent overfilling of the boiler and to cause boiling of the water without draining during start up so that the water acquires a predetermined higher level of conductivity so that the electrode boiler operates efficiently. An abnormal operation light and high and low current indicators are also provided to inform an operator of the status of operation of the control.

30 Claims, 3 Drawing Figures

DIGITAL ELECTRONIC STEAM HUMIDIFIER CONTROL

BACKGROUND OF THE INVENTION

I. Field of the Invention

The invention relates to humidifier systems which utilize an electrode boiler to generate steam by passing current through and between boiler electrodes submerged in water, and more particularly, to automatic controls for such humidifier systems for regulating the level of water in the boiler in conjunction with regulating the magnitude of the electrode current used for steam generation.

II. Description of the Prior Art

Prior humidifier systems including typical automatic controls are disclosed in Dall, U.S. Pat. No. 3,761,679, issued Sept. 25, 1973, Eaton Williams, U.S. Pat. No. 3,780,261, issued Dec. 18, 1973, and Eaton Williams, British Pat. No. 1,139,911.

This invention is concerned with this general area and has among its general objects to provide an automatic control for a humidifier system which utilizes digital logic circuitry and which includes improved modes of operation and other features not available in the prior art.

More particularly, this invention has among its principal objects to provide an electronic steam humidifier control which utilizes digital logic circuitry to regulate the boiler water level and magnitude of electrode current in accordance with a normally repetitive fill, boil, fill-on-drain cycle.

Another of the principal objects of the invention is to provide such a control incorporated in a humidifier system which can be utilized efficiently with local tap water having broad ranges of conductivities, the control automatically enriching the local tap water to a predetermined higher conductivity suitable for efficient boiler operation before the normally repetitive cycling occurs.

Another of the objects of the invention is to provide such a control which includes an abnormal operation indicator and high and low current indicators to inform the operator of the status or stage of operation of the electrode boiler and the control.

Another object of the invention is to provide such a humidifier control including digital logic circuitry which provides reliable and efficient control over the operation of the humidifier system, the control including a comparator network which provides a plurality of digital outputs having high or low states dependent upon the magnitude of electrode current.

SUMMARY OF THE INVENTION

In order to achieve the foregoing and other objects, the invention provides a method and an electronic steam humidifier control including digital logic circuitry for regulating the power input into an electrode boiler of a humdifier system in accordance with a normally repetitive fill, boil, fill-on-drain cycle. The invention also provides a humidifier control including digital logic circuitry operative to provide a drain mode of operation, rather than a fill-on-drain mode of operation, at the end of a repetitive cycle.

In order to achieve the preferred fill, boil, fill-on-drain repetitive cycle, the control includes current sensing means for providing an analog signal proportional to the magnitude of electrode current, and circuit control means connected to the current sensing means for receiving the analog signal and for energizing an electrically controlled water fill valve to fill the boiler with water when the magnitude of the electrode current is less than a normal lower current limit. Thereafter, when the boiler is filled with water to a level where the electrode current has increased to above a normal upper current limit, the circuit control means is operative for deenergizing the fill valve and allowing the water to boil. Thereafter, when the water level in the boiler has dropped to where the magnitude of the electrode current has decreased to an intermediate level, the circuit control means is operative for energizing an electrically controlled drain valve and the water fill valve, the drain valve having a greater capacity than the fill valve so that somewhat cooled water is drained from the boiler. Thereafter, when the water level of the boiler has decreased to where the magnitude of the electrode current is below the lower current limit, the circuit control means is operative for deenergizing the water drain valve to end the cycle, and for maintaining the fill valve in an energized state to initiate repeating the fill, boil, fill-on-drain cycle.

According to a preferred embodiment of the invention, the circuit control means is made up of a comparator network for receiving the analog signal proportional to the electrode current and for providing a plurality of digital output signals each having a high or low state depending upon the magnitude of the electrode current. The circuit control means also includes logic circuit means including a plurality of NAND gates and for receiving and processing the plurality of digital output signals so that the humidifier control normally regulates the power input or electrode current in accordance with the repetitive fill, boil, fill-on-drain cycle.

Also in accordance with a preferred embodiment of the invention, the comparator network means includes a plurality of comparators each having an output for providing one of the plurality of digital output signals, each comparator having one input connected to receive the analog signal. In order to establish the magnitude of the normal lower, intermediate, and normal upper current limits, the circuit control means includes current level means for providing an adjustable reference voltage, and voltage divider means for providing scaled voltages proportional to the reference voltage. The reference and scaled voltages are respectively connected to the other input of each of the comparators not connected to the analog signal so that a different one of the plurality of digital output signals changes state each time the electrode current exceeds a corresponding different one of the current limits.

The circuit control means also preferably includes fill and drain driver means for respectively energizing the electrically controlled water fill and water drain valves. In order to insure that a minimum amount of water is supplied to the boiler during each cycle, the circuit control means includes minimum fill timer means for energizing the fill driver means so that water flows into the boiler for a predetermined minimum length of time after the drain valve has been deenergized at the end of the fill, boil, fill-on-drain cycle.

In order to prevent excessive electrode current from tripping a circuit breaker and shutting down the humidifier system due to initial heating or inadvertent overfilling of the water in the boiler, the circuit control means also preferably includes over-current timer means. The timer means initiates and selectively repeats an over-current mode of operation which temporarily interrupts the fill, boil, fill-on-drain cycle when the magnitude of the electrode current exceeds an over-current limit greater than the normal upper current limit. The over-current mode of operation includes disconnecting the boiler electrodes from the AC power source, thus preventing tripping of a circuit breaker, and energizing the drain valve to drain water from the boiler, all for a period of time determined by the timer. The over-current mode of operation repeats at the end of the predetermined period of time unless the magnitude of the electrode current has decreased to below the over-current limit, at which point normal cycling begins or resumes.

In order to condition the water in the boiler to a predetermined higher conductivity, the circuit control means also preferably includes high water probes connected to over-fill sensor means which is operative to deenergize the fill driver means so that the flow of water into the boiler is interrupted when the boiler water level rises so that the high water probes are submerged in water. The over-fill sensor means allows the water in the boiler to boil and become mineral enriched and, thereafter, allows the fill driver means to be reenergized if the water level in the boiler has dropped so that the high water probes are no longer submerged. The over-fill sensor means preferably includes delaying means so that the fill driver means is not deenergized in response to momentary splashing or momentary submersion of the high water probes.

In order to alert the humidifier system operator to abnormal operation, the circuit control means also preferably includes an abnormal operation light which is illuminated, for example, when the magnitude of the electrode current decreases below an under-current limit less than the normal lower current limit. The circuit control means also preferably includes low and high current indicators or LEDs which indicate whether the electrode current is outside the range between the normal lower and normal upper current limits. To insure the desired sequence of operation, flip-flop means are preferably connected in circuit with the NAND gates and are provided for preventing the drain valve from being energized during the fill portion of the fill, boil, fill-on-drain cycle.

Other objects, features, and advantages of the embodiments of the invention will become known by reference to the following general description, the appended claims, and the drawings.

DESCRIPTION OF THE PREFERRED EMBODIMENT

Figure 2:
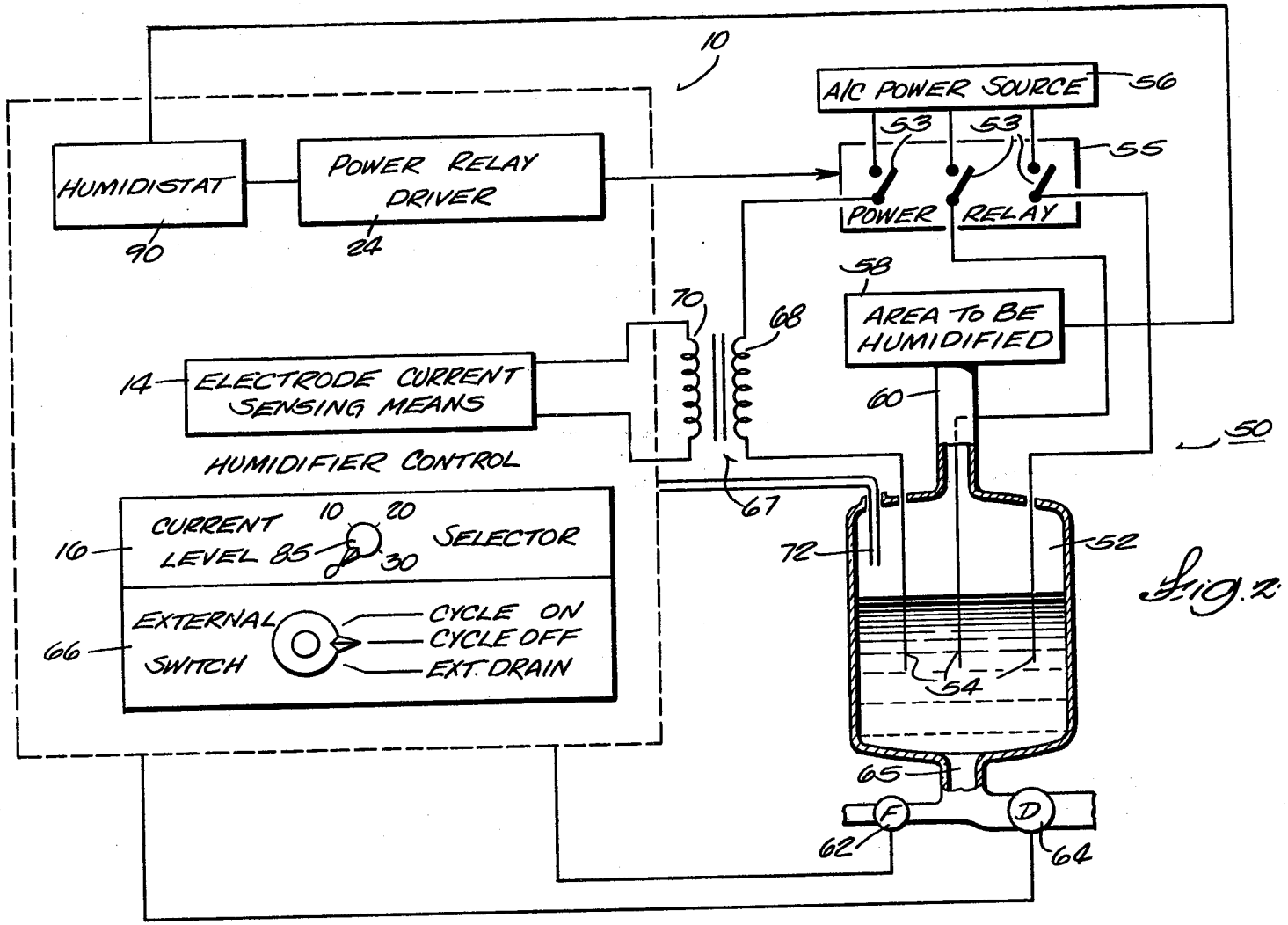
FIG. 2 is a diagrammatic view of a humidifier system incorporating the humidifier control shown in FIG. 1.

Shown diagrammatically in FIG. 2 is a humidifier control 10 incorporated in a humidifier system 50 according to the invention and which includes a boiler 52 having electrodes 54. While other electrode and power supply arrangements could be utilized, current is preferably supplied by a conventional three-phase AC power source 56, subject to a power relay or contactor 55, which in turn, is energized to connect the electrodes to the AC power source by a power relay driver 24 included in the control 10.

Assuming the external switch 66 is adjusted to a "cycle on" position, when humidity in the area 58 to be humidified is called for, a humidistat 90 and associated circuitry (FIG. 3) provides an output which energizes the power relay driver 24 so that the electrodes are connected to the AC power source. During normal operation, current flows through and between the electrodes 54, and the electrode current level and boiler water level are regulated in accordance with a normally repetitive fill, boil, fill-on-drain cycle, resulting in steam being conveyed by conduit 60 to the area 58 to be humidified.

Water is fed into the boiler 50 by an electrically controlled fill valve, such as a solenoid fill valve 62 (diagrammatically shown), which opens in response to the fill solenoid driver 22 being energized. Similarly, water is drained from the boiler by an electrically controlled valve, such as a solenoid drain valve 64 (diagrammatically shown) which opens in response to the drain solenoid driver 20 being energized. The solenoid fill and drain drivers 20 and 22, and the power relay driver 24, are preferably constructed to provide signal amplification and isolation so that the low power outputs from the digital logic circuitry of the control 10 can drive the high power, high current solenoid fill and drain valves 62 and 64, and the power relay 55.

As illustrated, water is fed into the boiler and drained from the boiler through a T-shaped conduit 65 including the fill and drain valves and which is connected to the bottom of the boiler. As will be described in more detail below, the drain valve 64 has a larger capacity than the fill valve 62 so that when both valves are energized or open the net effect is to drain water from the boiler.

Before going into a more detailed circuit description, the remaining major components or groups of components of the humidifier control 10 will be identified and the normal cycle and other special modes of operation of the control will be generally described. As illustrated by block and schematic diagram in FIG. 1, the control 10 includes a comparator network 12, connected to receive an analog voltage from electrode current sensing means 14, and to receive a reference voltage and scaled voltages from a current level selector 16, and a voltage divider network 17.

The comparator network 12 provides a plurality of digital output signals each having a high or low state dependent upon magnitude of the electrode current, as represented by the analog voltage, when compared to the reference or scaled voltages. The output signals are connected to a plurality of NAND gates (see FIG. 3) collectively referred to and represented in FIG. 1 as logic circuit means 18. The logic circuit means 18 selectively energizes the fill and drain solenoid drivers to provide the normal fill, boil, fill-on-drain cycle as will be described below.

The control 10 includes a power supply 36 which includes a transformer 37 to provide a stepped-down AC voltage, for example, 24 volts, which is rectified to provide unregulated and regulated DC voltages to suitably power circuitry of the control 10, subject to the external switch 66. The unregulated voltage (specifically labeled) powers an abnormal operation light 42 while a conventional integrated circuit (IC.) voltage regulator 37 provides a regulated voltage, for example 12 volts DC, (shown where connected (see FIG. 3) as an unlabeled closed arrow) which powers most of the other circuitry of the control 10.

The humidifier control also includes various other components which are utilized during the normal and special modes of operation, including high water probes 72 located in an upper portion or top of the boiler 52 and connected to over-fill sensor means 29, an IC. over-current timer 38, an IC. minimum fill timer 40, and low and high current indicators or LEDs 100 and 102 which can be utilized in combination with the abnormal operation light 42 to inform the operator of the status or stage of operation of the control.

As noted earlier, in order to assist in providing a basic understanding of the invention, a general description of the normal and special operating modes of the humidifier control 10 will be given before explaining the detailed structure and operation of the logic circuit means and other circuitry of the humidifier control.

During normal boiler operation, assuming operation starts with an empty boiler, the control 10 operates to energize the fill solenoid driver 22 and open the fill valve 62 so that the boiler 52 begins to fill with water. Since the electrode current is a function of the water level in the boiler, and also of the water conductivity, electrode current begins to flow and increases as the boiler is filled with water. Assuming normal operation, when the boiler has filled with water to a level where the electrode current has increased to above a predetermined normal upper current limit, designated I set point ($I_{sp.}$), the control 10 operates to deenergize the fill solenoid driver and close the fill valve 62, ending the fill portion of the cycle and initiating the boil portion of the cycle. During the boil portion the water starts or continues to boil.

As the water boils, the level of water in the boiler, and hence the electrode current, decreases. When the water level in the boiler has decreased to where the electrode current has decreased to an intermediate current limit, having a magnitude a given percentage less than $I_{sp.}$;, for example $I_{sp.}-7\%$, the control 10 switches to the fill-on-drain portion of the cycle. Specifically, the control 10 operates to simultaneously energize the drain solenoid driver 20 and open the water drain valve 64 and energize the fill solenoid driver 22 and open the water fill valve 62. As shown diagrammatically in FIG. 2, the drain valve 64 is relatively larger or has a greater capacity than the fill valve 62, so that when the fill and drain valves are both open, the net effect is that water is drained from the boiler and the water level decreases. During the fill-on-drain operation, the hot water being drained is mixed with the cold water supplied from the fill valve so that the water drained is cooled to a lower temperature which prevents live steam from flowing in the drain pipes.

When the water level in the boiler has drained to where the electrode current has decreased to below a predetermined normal lower limit, for example, $I_{sp.}-15\%$, the control 10 operates to deenergize the drain solenoid driver and close the drain valve thereby ending the cycle, but at the same time maintains the fill solenoid maintains the fill solenoid driver in an energized state to keep the fill valve open, thus initiating another fill, boil, fill-on-drain cycle as described. It should be understood, of course, that during succeeding fill, boil, fill-on-drain cycles, the fill mode is initiated when the electrode current has decreased to just below $I_{sp.}-15\%$, as opposed to the initial filling of the boiler when the electrode current starts at zero.

The electrode current is proportional to the power utilized to produce steam in the humidifier system, assuming a generally constant voltage is produced by the Ac power source 56. Since the electrode current varies during the fill, boil, fill-on-drain cycle between a predetermined normal upper current limit or $I_{sp.}$, and a predetermined normal lower current limit, for example, $I_{sp.}-15\%$, the control 10 operates to regulate the power input into the humidifier system, and hence operates to regulate the amount of steam produced during normal operation of the humidifier system. As will be explained in more detail below, the current level selector 16 allows an operator to select the magnitude of the normal upper current limit or $I_{sp}$.

As noted above, the magnitude of the electrode current, and hence the power input and steam generated, is also a function of the local water conductivity. The humidifier control is adapted to condition the water in the boiler to a predetermined higher conductivity so that the humidifier control 10 can be utilized in combination with a boiler having a standard electrode configuration which is set to operate efficiently with water having the predetermined higher conductivity. The predetermined higher conductivity is selected to be higher than the conductivity of the local water in which the boiler and humidifier system are to be used to eliminate the systems dependence on local water conductivity.

More particularly, during initial start-up or filling of the boiler, if the conductivity of the water in the boiler is not at the predetermined higher conductivity, the water level will rise so that the high water probes 72 are submerged before the electrode current increases above the normal upper current limit or I set point. When the probes 72 are submerged, current passes between the high water probes, thereby actuating the control 10 to initiate an overfill mode, i.e., to deenergize the fill solenoid driver and close the fill valve, the power to the electrodes remaining on. The abnormal operation light 42 is also turned on when the high water probes are submerged. This overfill mode normally causes the water to boil and, since the fill valve is closed, the water level drops.

After the water level drops so that the high water probes 72 are no longer submerged, the control 10 returns to its previous state, allowing the fill valve to be opened, assuming the electrode current has not yet reached $I_{sp}$. The fill valve remains open and the water level in the boiler again rises to submerge the high water probes. Because there is no drain cycle, the minerals in the water continue to increase in concentration as the water level cycles around the level of the high water probes, and hence, the water conductivity increases. As will be described below, the control 10 includes delay means so that splashing or momentary contact of water with the high water probes does not cause the fill valve to be deenergized or the overfill mode to be initiated.

When the conductivity of the water increases to the predetermined higher conductivity, or to the point where the electrode current reaches $I_{sp.}$ before the high water probes are submerged, the control 10 returns to the boil mode of the normal fill, boil, fill-on-drain cycle, as described above. Thus the control 10 actively conditions the water so that its conductivity is tailored to the high conductivity at which the boiler is designed to operate efficiently. This eliminates the necessity to adjust the boiler electrode configuration, or the predetermined current limits utilized by the control to provide the desired amount of steam, depending upon the variance in lower water conductivities in the area in which the humidifier system is located. In addition to the control 10 operating to condition the conductivity of the water before normal cycling takes place, there are several other special modes of operation departing from or modifying the normal fill, boil, fill-on-drain cycle which the humidifier control provides.

More particularly, the humidifier control 10 includes a minimum fill timer 40 connected to the logic circuit means 18, and which assures that when the fill valve is first energized during the fill portion of the cycle, the fill valve remains open for at least a predetermined length of time, for example, 15 seconds. This feature is provided to insure that an adequate amount of water will be supplied to the boiler and so that the water level will not remain at or near the bottom of the electrodes causing a potentionally damaging arcing and sparking condition.

The control 10 also includes the abnormal operation indicator or light 42 which, in combination with the low current indicator LED 100 (described below), alerts the operator that the current level has dropped below an abnormal lower limit, for example, $I_{sp.}-25\%$. This informs the operator that for some reason the boiler is not producing the desired amount of steam, for example, because there is no water in the boiler, or the boiler has filled up with precipitate. Also, if the boiler fills up with precipitate, the electrode current may be so low that boiling will not occur, and hence, the water will remain at a level above the high water probes during an overfill mode and the abnormal operation light will remain on.

The control 10 is also constructed to react to a situation where the electrode current increases beyond the predetermined normal upper current limit $I_{sp.}$ to above an over-current limit, for example, $I_{sp.}+20\%$. The control then responds to initiate an overcurrent mode of operation to reduce the water level and the electrode current so that normal cycling can continue. This over current situation might occur, for example, for one of two reasons. Occasionally, due to a leaking fill valve, the water level in the boiler will rise above a normal level or fill up the boiler when the boiler is shut off for a period of time when humidity is not called for. When this occurs, the boiler may draw excessive electrode current when it is started up.

More specifically if the electrode current exceeds, for example, $I_{sp.}+20\%$, the control initiates an over-current mode of operation wherein the power relay driver 24 is deenergized and the power to the boiler electrodes is turned off. At the same time, the over-current timer 38 of the control 10 operates to energize the drain solenoid driver to open the drain valve so that it remains open for a predetermined period of time, for example, 15 seconds. The fill valve 62 is also energized at this time, but as described above, the net effect is to drain water from the boiler. The abnormal operation light 42 and high current LED 102 are also on. After the 15 seconds, the above actions are reversed. If the electrode current still exceeds $I_{sp.}+20\%$, the above described over-current mode is repeated, the repeated 15 second drain periods eventually dropping the level of water in the boiler until the magnitude of the electrode current should become less than $I_{sp.}+20\%$. At this point, the control returns to the interrupted step of the normal fill, boil, fill-on-drain cycle, the abnormal operation light turning off, but the high current LED remaining on until electrode current decreases below $I_{sp.}$ An over-current condition can also occur during initial boiler start up when the water is being heated, since the conductivity of the water generally increases with temperature. If the electrode current increases to exceed the over-current limit or $I_{sp.}+20\%$ as a result of the initial increase in water temperature, the control 10 initiates and selectively repeats an over-current mode of operation as previously described, until the electrode current is less than $I_{sp.}+20\%$ at which time the unit will return to a normal mode of operation. The control 10 and this over-current mode of operation prevents a main circuit breaker (not shown) from completely turning off or shutting down the control since the power to the electrodes is temporarily cut off if the electrode current exceeds the over-current limit during start up. Thus, the humidifier system can remain operational without requiring operator intervention to reset a main circuit breaker.

As shown diagrammatically in FIG. 2, the control 10 also includes an external operation switch 66 which can be operated to turn the control on or off or to put the control into an external drain mode. In the external drain mode, the drain and fill valves are open, power to the electrodes is off and the abnormal operation light is on. Of course it should be appreciated that the operation of the control and logic circuit control means is subject to and can be interrupted by the humidistat 90. If the humidstat 90 indicates that no humidity or steam generation is called for, the power relay driver 24 is deenergized and power to the electrodes is turned off.

DETAILED DESCRIPTION OF LOGIC CIRCUIT OPERATION

Figure 1:
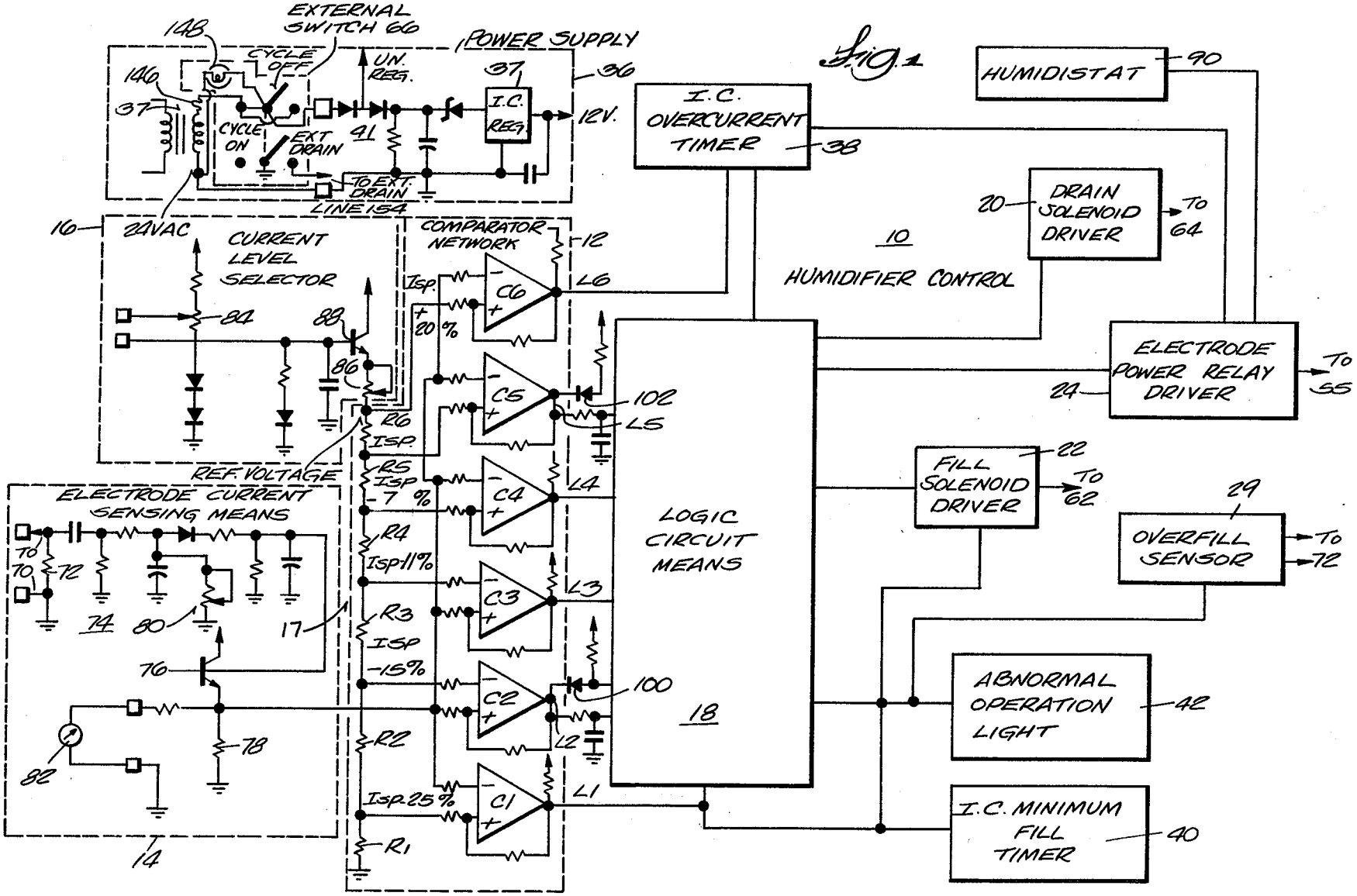
FIG. 1 is a schematic and block diagram of a humidifier control embodying various features of the invention.

As shown in FIG. 1, the comparator network 12 is preferably made up of six differential comparators, labelled from bottom to top, as C1, C2, C3, C4, C5, and C6. The comparators each provide a digital output signal having either a high or low state depending upon whether the magnitude of the electrode current, represented by an analog voltage signal connected to one input, is greater than or less than a reference voltage or scaled voltage establishing an electrode current limit and connected to the other input of the comparator.

More particularly, the humidifier control includes the electrode current sensing means 14 for providing an analog signal or voltage proportioned to the magnitude of the electrode current. The current sensing means is preferably in the form of a transformer 67 having a primary coil 68 in series with one of the AC power lines going to the boiler electrodes 54 (see FIG. 2). The secondary coil 70 of the transformer 67 provides an AC analog current signal which is proportional to the AC current or electrode current flowing through the power line and between the electrodes 54. The analog current signal develops an analog voltage signal across resistor 72 (FIG. 1), which signal is further processed by components (not specifically labeled) which form a rectifier, generally designated 74, and by a transistor 76 and resistor 78 or other amplifying means such as a voltage follower or buffer amplifier to provide the desired DC analog voltage or signal output. The rectifier 74 includes a potentiometer 80 which can be used to adjust the magnitude of the analog voltage, which remains proportional to the electrode current, so that the control 10 can be utilized with a suitable meter 82, such as a milliammeter, which is marked to provide a readout in lbs. per hour of steam the humidifier system is producing.

The remaining components or circuit control means making up the control 10 includes current level means or an electrode current level selector, generally designated 16, which provides an adjustable reference voltage corresponding to the analog voltage signal and is utilized in conjunction with the comparator network 12 to establish the levels of electrode current at which the control responds to provide the fill, boil, fill-on-drain cycle and other modes of operation. Specifically, the reference voltage is derived from the DC voltage provided by the power supply 36 and its maximum valve is set by adjustment of potentiometer 86 connected to transistor 88 or other amplifying means such as a voltage follower or buffer amplifier. These and the other illustrated components in the current level selector 16, (FIG. 1) provide a DC reference voltage of desired magnitude at the point in the circuit labeled "Ref. Voltage". The reference voltage is directly connected to the positive input of Comparator C6 and connected through a voltage divider network generally designated 17 and including resistors R1, R2, R3, R4, R5, and R6, which have resistance values selected for establishing scaled voltages proportional to the reference voltage and which are connected to the other one of the inputs of each of the comparators C1 through C5 not connected to the analog voltage. The reference voltage establishes the over-current limit, for example, $I_{sp.}+20\%$, and the scaled voltages applied to an input of comparators C5, C4, C3, C2, and C1, respectively, establish, for example, $I_{set\ point}$, ($I_{sp.}$) $I_{sp.}-7\%$, $I_{sp.}-11\%$, $I_{sp.}-15\%$, and $I_{sp.}-25\%$, as labeled in FIG. 1. As noted earlier, for purposes of example in this description, $I_{sp.}$ corresponds to the electrode current normal upper current limit, $I_{sp.}-7\%$ and $I_{sp.}-11\%$ correspond to intermediate current limits, $I_{sp.}-15\%$ corresponds to the normal lower current limit, and $I_{sp.}-25\%$ corresponds to an under-current limit.

In order to calibrate the control 10, the potentiometer 86 of the reference current selector 16 is adjusted so that for a full scale adjustment of the potentiometer 84, the normal upper current limit or $I_{sp.}$ is, for example, 30 amps. As shown diagrammatically in FIG. 2, the potentiometer 84 can thereafter be adjusted by a dial 85, connected to potentiometer 84, so that the normal upper current limit for electrode current can be varied, for example, from 0 to 30 amps. Also, since the reference voltage corresponds to $I_{sp.}+20\%$, the first adjustment of potentiometer 84 limits the maximum amount of electrode current which will be allowed to flow through the electrodes 54 in the boiler.

Returning to a description of the comparator network 12, current limiting resistors (not specifically labeled) are also provided at each of the comparator inputs and between the positive input and output of each of the comparators to balance out comparator input bias currents, and to provide some hysteresis on the comparison level so that the comparator output does not switch back and forth for small excursions about the input threshold. Power is suitably provided to the comparators through resistors (not specifically labeled) connected to regulated voltage provided by the DC power supply 36, as shown. The voltage divider network resistors are selected, and the analog voltage and reference voltage and scaled voltages are applied to the positive or negative inputs of comparators C1 through C6 as shown so that the comparator network 12 provides a six-line digital output. A different one of the digital outputs changes state each time the electrode current increases above or decreases below a corresponding different current limit, e.g., $I_{sp.}-25\%$, $I_{sp.}-15\%$ etc., to provide the normal repetitive fill, boil, fill-on-drain cycle and the other modes of operation of the control.

Figure 3:
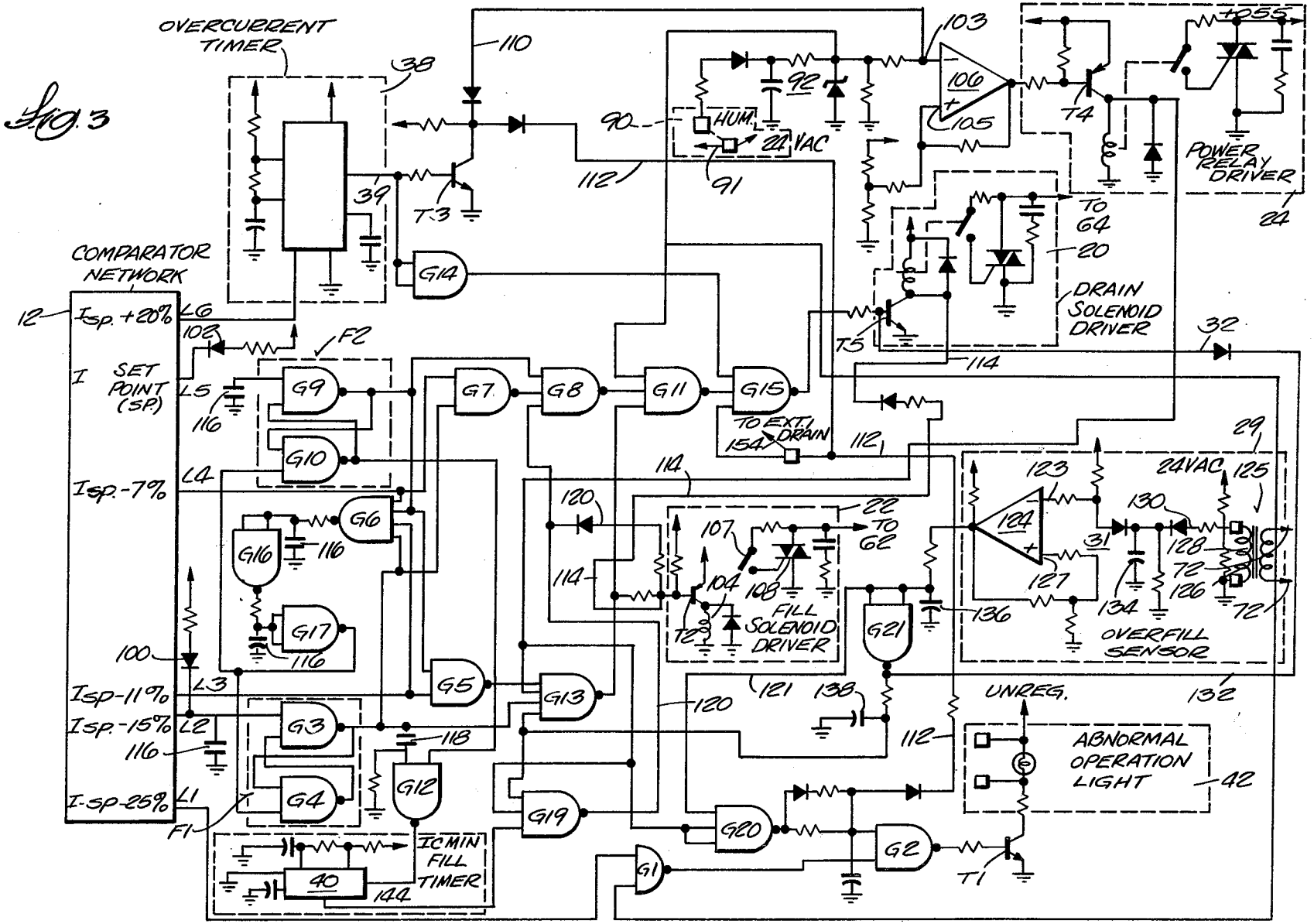
FIG. 3 is a schematic diagram illustrating further details of the humidifier control shown in FIGS. 1 and 2.

A description of the logic circuitry and other components of the control 10 will be given in conjunction with the following detailed description of operation. During such description, reference will be made to the logic states on the output lines labelled L1, L2, L3, L4, L5, and L6 as shown in FIG. 3, which lines respectively carry the outputs of comparators C1 through C6. It is to be understood of course, that the NAND gates operate so that if any input has a low state, the output of the NAND gate is high, and the output of the NAND gate is low, only if the state of all the inputs to the NAND gate is high. Also, while reference is made herein to NAND gates, it is to be understood that other equivalent and suitable logic elements or combinations of logic elements (e.g., AND or OR, or INVERTING gates) could be substituted for one or more NAND gates, so long as such substituted logic elements provide the same required logic operation and control, as will be discussed below.

During initial startup of the humidifier control 10 the boiler 52 is empty, and the electrode current or analog voltage signal is zero. Assuming the humidistat 90 is on or calls for production of steam and the external switch 66 (described below) is set to "cycle on", the power relay driver 24 is energized and power to the electrodes is on. Specifically, when the humidifier 90 calls for steam, the humidifier switch 91 closes and connects an AC control voltage, for example 24 volts, to a rectifier circuit, generally designated 92. The rectifier circuit provides a high signal to the negative input 103 of comparator 106, the comparator 106 having a positive input 107 suitably biased as shown so that the output of comparator 106 changes from a high to a low state, turning on transistor T4 which energizes the power relay driver 24 to close the contacts 53 of the power relay 55 so that the boiler electrodes are connected to the AC power source.

At this point, the state of the digital outputs on lines L1, L4, L5, and L6 is high and the logic circuit means is operative so that the fill solenoid driver 22 is energized so that the boiler begins to fill with water, and the drain solenoid driver 20 is deenergized so that the drain valve is closed. Also, the abnormal light 42 is on, indicating electrode current flow is less than $I_{sp.}-25\%$. The digital outputs on line L2 and L3 are low because, unlike comparators C1, C4, C5, and C6, the positive inputs of comparators C2 and C3 are connected to the analog voltage, which is zero during start-up, and the negative inputs of comparators C2 and C3 are connected to the greater than zero scaled voltages provided by the voltage divider network, as shown.

After the electrode current has increased to a magnitude greater than $I_{sp.}-25\%$, the negative input of comparator C1 has a voltage greater than the scaled voltage conveyed to the positive input of C1 and the output on line L1 changes from a high to a low state, resulting in NAND gate G1 (see FIG. 3), coupled to line L1, changing output state from low to high, and gate G2 coupled to the output of G1 changing state from high to low, thereby cutting off the base drive of transistor T1 so that the abnormal light 42 turns off. This is the only change in the humidifier control which occurs as the electrode current increases from zero to a magnitude greater than $I_{sp.}-25\%$. It should also be noted that a low current indicator LED, designated 100, is connected to the low output of C2 and is biased on to indicate to an operator that the electrode current is still less than $I_{sp.}-15\%$.

When the boiler electrode current has increased above $I_{sp.}-15\%$, the output on line L2 connected to comparator C2 changes from low to high, thereby turning off LED 100 and also conditioning one of the inputs of gate G3 which is one of a pair of cross coupled gates which form a flip-flop designated F1. The other gate of flip-flop F1 is designated G4. For purposes of this description, when a gate is "conditioned" it means that one or more inputs of the gate changes state, but the output of the gate does not change state. Again, the boiler continues to fill with water and no other changes in control 10 occurs until the electrode current increaases above $I_{sp.}-11\%$.

When the electrode current increases to above $I_{sp.}-11\%$, line L3 connected to comparator C3 changes state from low to high, thereby conditioning gates G5 and G6 connected to line L3, but again no change in operation of the control results, and the boiler continues to fill.

When the electrode current has increased above $I_{sp.}-7\%$ the output on line L4 connected to comparator C4 changes from a high to low state, thereby changing the state of the output of gate G7 from low to high to condition gate G8, again there being no other change in the operation of the control.

When the electrode current increases above the normal upper limit or $I_{sp.}$, the fill valve 62 closes and the high current indicator or LED 102 is on. More particularly, the output on line L5 connected to comparator C5 changes from a high to a low state, and thereby turns on LED 102 and changes the state of or flips the pair of outputs of a flip-flop designated F2 and made up of gates G9 and G10. The now high output of gate G9 is connected to gate G8 which changes state to have a low ouput which conditions gate G11. The low output on line L5 also turns on the high current LED 102 to inform an operator that the electrode current has increased to above $I_{sp.}$. The high output of G9 is also connected to the input of G10 of the flip-flop F2 so that the output of G10 changes to a low state which conditions gate G12 which is connected to the minimum fill timer 40. At the same time, the high output from gate G9 is fed to gate G5 which changes its output state from high to low, which low output is connected to an input of gate G13 and causes it to change its output state from low to high, thereby turning off the base drive of transistor T2 of the fill solenoid driver 22, thereby closing the solenoid fill valve 62. The high output of gate G13 also conditions the gate G11.

As illustrated, the fill solenoid driver 22 is made up of a relay having a coil 104 which is energized when transistor T2 is on to close relay switch 107 which renders triac 108 conductive to carry the high current necessary to energize and open the solenoid fill valve 62, which is normally closed. Thus, when the electrode current increases above $I_{sp.}$, and causes the output of gate G13 to change from low to high to turnoff the transistor T2 as described above, the triac 108 is rendered non-conductive and the solenoid fill valve is deenergized and closed. At this time, assuming normal operation, the control is in a boil mode, i.e., the power to the boiler electrodes remains on, the fill and drain valves 62 and 64 are closed, and the water is allowed to boil, thus resulting in the water level in the boiler dropping, so that the electrode current begins to decrease.

Should the electrode current increase over $I_{sp.}+20\%$, as discussed earlier, an over-current mode of operation which turns off the power to the electrodes, turns on the abnormal operation light 42, and opens the drain and fill valves for a predetermined time occurs. More particularly, assuming the electrode current increases above $I_{sp.}+20\%$, the output on line L6 connected to comparator C6 changes from a high to a low state, actuating the I.C. over-current timer 38. The timer 38 can be a conventional integrated circuit component, and the predetermined period of time is determined by the time constant of the capacitor and resistors (not specifically labelled) connected to the timer 38 as shown.

When actuated, th timer 38 has an output 39 which changes from a low to a high state and which is connected to both inputs of gate G14 and to the base of transistor T3. Transistor T3 turns on providing a path to ground which causes the negative input 103 of the comparator 106, connected by line 110 to the collector of transistor T3, to go low, overriding the humidistat 90 and changing the output state of the comparator 106 from low to high. The high output of comparator 106 cuts off the base drive of transistor T4 of the power relay driver 24, thus deenergizing power relay 55 so that power to the boiler electrodes is cut off. As shown in FIG. 3, the construction and operation of the power relay driver 24 is substantially the same as the fill solenoid driver 22 and hence, will not be further described.

At the same time the electrode power is cut off, the high output from timer 38 coupled to both inputs of gate G14 causes gate G14 to change its output stage from high to low, which low output is coupled to gate G15 which changes its output state from low to high. The high output of gate G15 turns on transistor T5 of the drain solenoid driver 20, thus resulting in energizing and opening the normally closed solenoid drain valve 64. It should be noted that a high output turns on the drain solenoid driver transistor T5, since, as illustrated, it is an npn transistor, whereas a high output turns off transistors T2 and T4 of the fill solenoid an power relay drivers since they are pnp transistors. Otherwise, the construction and operation of all the drivers is substantially the same.

When the drain solenoid driver transistor T5 turns on, it connects line 114 which is connected to the collector of T5, to ground. Line 114, which is connected to ground or has a low state, is also connected to the base of transistor T2 which turns on to energize the fill solenoid driver 22, as previously described, to open the fill valve 62. The over-current timer 38 turning on the transistor T3 also results in line 112 connected to gate G2 having a low state to change the output state of gate G2 from low to high to turn on the abnormal operation indicator or light 42.

It should be noted that if the line 114 was eliminated, the fill valve would not be energized whenever the drain valve is energized. Thus, the humidifier control 10 would be operative to provide a drain mode of operation, rather than a fill-on-drain mode of operation, at the end of a repetitive cycle, but various features of the invention would still be obtained.

Returning to the description of the over-current mode of operation, the over-current timer 38 maintains the above described condition, i.e., electrode power off, drain and fill valves open, and abnormal light light on, for a predetermined period of time, for example, 15 seconds. At the end of this period, the output of the timer 38 returns to a low state and all the above actions are reversed. It should be appreciated that by opening the drain and fill valves, while turning the power to the electrodes off, the water level in the boiler will decrease since the drain valve has a greater capacity than the fill valve, as described earlier. Since the water level drops, the electrode current will be reduced when the power is restored.

If the electrode current is still greater than $I_{sp.}+20\%$ when the over-current mode or sequence is completed and the power to the electrodes is turned back on, the output on line L6 is again low so that the output of over-current timer 38 again becomes high and the over-current mode, wherein the power to the electrodes is shut off and the drain and fill valves are opened, is repeated for an additional period determined by the timer 38, for example, 15 seconds. When the electrode current has decreased to below $I_{sp.}+20\%$, the boil mode of a normal fill, boil, fill-on-drain cycle occurs, although the high current LED 102 remains on until the electrode current decreases below $I_{sp.}$ It should be noted that when the electrode power turns off, the current goes to zero. The abnormal light remains on, but the low current LED 100 turns on while the high current LED 102 turns off. When the timer output 39 changes from the high to low state after the predetermined time, e.g., 15 seconds, the power is returned to the electrodes and the electrode current rapidly increases to a level somewhat less than before the over-current mode occurred due to draining of the water from the boiler.

Returning to a description of a normal cycle, after the electrode current has increased to above the normal upper current limit or $I_{sp.}$, the fill and drain valves are closed and the water boils so that the water level decreases. This initiates the boil mode of operation of the cycle. When the electrode current decreases below $I_{sp.}$, the output on line L5 connected to comparator C5 changes state from low to high, thereby turning off the high current indicator LED 102, and also conditioning gate G9 of flip-flop F2. No other change in operation of the control is effected, the fill and drain valves remain off, power to the electrodes remains on and the water continues to boil so that the water level and electrode current continues to decrease.

When the electrode current decreases below $I_{sp.}-7\%$, the fill-on-drain mode, or energizing of the drain and fill valves occurs. More particularly, the digital output on line L4 connected to comparator C4 changes from a low to a high state, momentarily pulsing gates G6, G16 and G17 (described below) to flip the outputs of both flip-flops F1 and F2 and to open the drain and fill valves. More particularly, the high output on line L4 is coupled to an input of gate G6 which momentarily changes its output state from high to low, which momentary low output is coupled to both inputs of gate G16 which momentarily change its output state from low to high, which high output is coupled to both inputs of gate G17 to momentarily change its output state from high to low. The momentary low output of gate G17 flips the output of gate G3 in flip-flop F1 from high to low in response to the output of gate G4 of flip-flop F1 which momentarily changes its output state from low to high.

The low output of gate G3 is coupled to an input of gate G13 which causes the output state of G13 to change from low to high, which high output is coupled to gate G11 to cause its output state to change from high to low, which low output is coupled to gate G15 and which causes its output state to change from low to high. The high output of gate G15 provides base current for transistor T5 so that the drain solenoid driver 20 is energized to activiate or open the drain valve 64.

At the same time, the momentary low pulse from gate G17 is connected to and changes the state of the gate G10 of flip-flop F2 which, in turn, changes the output state of gate G9 of flip-flop F2 from high to low, which low output conditions gate G11 and also is coupled to gate G6 to return its output to a high state, in turn, reversing the effects of the momentary pulses or changing the output of gate G16 to a low state and the output of gate G17 to a high state. At the same time the high output of gate G10 of flip-flop F2 conditions the input of gate G12 having an output connected to the minimum fill timer 40.

As noted earlier, since line 114 is connected between the collector of transistor T5 and the base of transistor T2, when transistor T5 of the drain solenoid driver turns on, transistor T2 of the fill solenoid driver turns on so that the fill valve 62 is also opened. Also as explained above, since the drain valve 64 has a capacity greater than the capacity of the fill valve 62, the water in the boiler drains and the water level and the electrode current decreases during the fill-on-drain mode of operation.

The logic circuit means or NAND gates are arranged, as illustrated and described, so that the outputs of both flip-flops F1 and F2 are flipped to initiate the fill-on-drain mode, only when the electrode current decreases below $I_{sp.}-7\%$ and the output on Line L4 changes from a low to a high state. This arrangement prevents the drain valve from being energized when the electrode current is increasing during the fill mode portion of the repetitive fill, boil, fill-on-drain cycle. During start-up, four capacitors, each designated 116, provide charge delays which establish the initial states of flip-flops F1 and F2 so that the control 10 operates to provide the normal repetitive cycle as described.

When the electrode current decreases below $I_{sp.}-11\%$ the output on line L3 connected to comparator C3 changes from a high to a low state, which output conditions gate G5, and no other change occurs.

When the electrode current decreases to below $I_{sp.}-15\%$, the digital output on line L2 connected to comparator C2 changes from a high to a low state, turning on the low current LED 100 and flipping the output of gate G3 of flip-flop F1 to a high output which is coupled to gate G13 to change the output state of G13 from high to low. The low output of gate G13 is connected to gate G11 and changes the output state of gate G11 from low to high, which high output changes the state of gate G15 to low, thereby cutting off the base drive of transistor T5 of the drain solenoid driver to close the drain valve 64.

At the same time, the high output from gate G3 pulses an input of gate G12 through capacitor 118 so that the positive going transition of flip-flop F1 temporarily changes the output state of the gate G12 from high to low, causing the IC. minimum fill timer 40 to turn on or to provide a high output on line 44 for a predetermined period of time, which output is coupled to a gate G19. The output of G19 changes state from high to low for the predetermined period of time, and the low output of G19 is conveyed to the base of transistor T2 of the fill solenoid driver 22 by line 120 to maintain transistor T2 on and insure that the fill valve 62 remains open for the minimum period of time, determined by timer 40, for example, 15 seconds. The minimum fill timer 40, including the means for selecting the predetermined period of time, is substantially the same as the over-current timer 38 previously described.

At this point, as the boiler again fills with water, the electrode current increases and the control again operates to provide a normal fill, boil, fill-on-drain cycle as described. The flip-flops F1 and F2 insure that the minimum fill timer 40 is activated only when the electrode current is decreasing and has decreased to below $I_{sp.}-15\%$ during the normal repetitive cycle.

As noted earlier, this normal cycle of operation is interrupted if the high water probes 72 are submerged, i.e., if the water has increased to a level where the boiler is over filled. More particularly, the control 10 includes an over fill sensor 29 (FIG. 3) connected to the high water probes 72 so that if water extends between the probes, the negative input 123 to a comparator 124 changes state from high to low, causing the comparator 124 to have an output which changes state from low to high. More particularly, the overfill sensor 29 includes biasing circuitry, generally designated 31, connected to the regulated DC voltage and to a 24 volt AC supply, and which is connected to a transformer 125 with one winding 126 having opposite ends respectively attached to the separate wires which connect to the high water probes 72. When the water level in the boiler rises to submerge or touch the probes 72, the resistance between the probes drops and the AC impedance along line 130 connected to the other transformer winding 128 also drops so that the voltage at the negative input 123 of comparator 124 drops relative to the suitably biased positive input 127 of the comparator 124 so that the output of comparator 124 changes from low to high. Specifically, the voltage at the negative input 123 remains at substantially 12 volts until the probes are submerged, at which point the voltage drops due to a voltage divider effect caused by the impedance of line 130 dropping.

The high output of comparator 124 is coupled to a gate G20 by line 121 so G20 changes its output state from high to low, in turn, changing the output state of gate G2 from low to high so that the abnormal operation light turns on. The high output of comparator 124 also changes the output state of a gate G21 from high to low, which low output is coupled by line 132 to transistor T5 of the drain solenoid driver so that the drain valve is kept closed. The low output of gate G21 is also coupled to gates G13 and G19 to change the output states of these gates from low to high. The high output from gate G19 is coupled by line 120 as previously described to turn off transistor T2 of the fill solenoid driver to keep the fill valve closed. Thus, the drain and fill valves are closed and the power to the electrodes remains on.

The water continues to boil while the fill and drain valves are closed until the water level drops below the level of the high water probes, at which point the above actions are reversed.

The over-fill sensor means includes delaying means for preventing the sensor means from deenergizing the fill solenoid driver for a predetermined period of time after the high water probes are submerged in water. Specifically, the delaying means is in the form of capacitors 134, 136, and 138 which are connected to the negative input of the comparator 124 and to the inputs and outputs of gate G21 as shown. The capacitors prevent splashing or momentary submersion of the high water probes 72 from changing the output states of the comparator 124 and gate G21 so that such splashing and momentary submersion does not close the fill valve. If the water fails to boil below the level of the high water probes, the abnormal light remains on and alerts an operator to check the condition of the boiler, which for example, may be full of precipitate and need to be replaced. As noted earlier, the over-fill mode results in conditioning the water in the boiler to have a predetermined higher conductivity at which the boiler is designed to operate efficiently. If desired, line 121 extending between the output of comparator 124 and an input of gate G20 could be eliminated so that the abnormal operation light does not come on when the high water probes 72 are submerged, for example, when the conductivity of the water is being conditioned as described above.

If the humidistat 90 fails to call for humidity so that switch 91 opens, the output of comparator 106 changes from a low to high state, turning off the transistor T4 and deenergizing the power relay driver 24, thus cutting off power to the electrodes. The low current indicator LED 100 coupled to the output of comparator C2 remains illuminated, but the abnormal light is off, thus informing the operator that operation is normal and that the humidistat is not calling for generation of steam. Of course, when the power to the electrodes is cut off by the humidstat, the drain and fill valves are also normally deenergized or closed.

As noted earlier, the control 10 includes an external switch 66 having positions corresponding to cycle on, cycle off, and external drain. During the external drain, the fill and drain valves are open to drain water from the boiler and the power to the electrodes is off. More specifically, as shown in FIG. 1, the external switch 66 consists of a double-pole, double-throw, center-off switch including a pair of switch blades 140 each respectively connected to upper and lower center contacts, and mechanically linked together for simultaneous movement.

As illustrated, the switch 66 conventionally includes upper and lower sets of three contacts (not specifically labeled). The upper set of contacts includes a center contact connected to the rectifier circuitry, generally designated 41, of the power supply 36, and left and right contacts electrically connected together. The upper left contact is electrically connected in series with a fuse 146 to the upper end of a winding of the transformer 37 which provides 24 volts AC. A power-on light 148 is connected to the lower end of the same winding and to the upper center contact of the switch 66 as shown. When a switch blade 140 is moved into engagement with either the upper left or upper right contact, the rectifier circuitry 41 is connected to and powered by the 24 volts AC to provide the unregulated and regulated voltages which power the circuitry of the control 10. When the upper switch blade 140 is moved to a center off position out of engagement with the left and right contacts, the 24 volts AC is cutoff from the rectifing circuitry 41 and the control 10 is off. Accordingly, the fill and drain solenoid drivers, 20 and 22, and the power relay driver 24 are deenergized so that the fill and drain valve 62 and 64 are closed and the power to the electrodes is off. The power on light 148 is also off since no current flows from the transformer to the rectifier circuitry 41 of the power supply.

As illustrated, the lower set of three contacts of the switch 66 includes a center contact connected to ground, a right contact connected to an external drain line 154 (described below) and a left contact which is unconnected. When the switch blades 140 are moved into engagement with the right contacts or into an external drain position, the 24 volts AC is connected to the rectifier circuitry 41 so that control 10 is provided with power, as described above, and the lower right contact and external drain line 154 are connected to ground through the lower center contact. As illustrated in FIG. 3, the external drain line 154 is connected to an input of NAND gate G15 so that when the switch 66 is moved to the external drain position and line 154 is connected to ground, the output of gate G15 is high, thereby providing base drive for the drain solenoid transistor T5 to open the drain valve 64. At the same time, the low state on the external drain line 154 is connected by lines 112 and 110 to the negative input 103 of comparator 106, thereby overriding the output of the humidistat 90 and causing the output of comparator 106 to go high. The high output cuts off the base drive of the power relay driver transistor T4 so that the power to the boiler electrodes is turned off. The low state on line 112 also causes the output of gate 62 to go high and causes the abnormal operation light 42 to turn on. As previously described, since transistor T5 is connected to the fill solenoid driver transistor T2 by line 114, the fill valve 62 is also opened when the drain valve is open so that water drains from the boiler.

In order to select normal cycle operation, the switch blades 40 are moved so that they engage the left contacts. The upper left contact completes a circuit to the 24 volts AC so that power is supplied to the control 10, and the lower left contact is unconnected so that the external drain line 154 is not connected to ground. Thus, a normal repetitive fill, boil, fill-on-drain cycle occurs as previously described.

In the above description, reference was made to several conventional logic components which, individually, are readily available from commercial suppliers. For example, the IC. voltage regulator 37 could consist of a Texas Instrument's voltage regulator Model No. uA78M12, and the over-current timer 38 and minimum-fill timer 40 could each consist of a Signetic's timer Model No. NE555. Also, although the NAND gates have been illustrated individually for the sake of clarity, it is to be appreciated that several NAND gates can be combined into a single integrated circuit element. Again, for the sake of clarity, the power and ground connections to the NAND gates have not been specifically shown.

Also, as was noted throughout the description, several of the common electrical elements included in the circuitry of the major components of the control 10 have not been specifically labeled or described since their operation or function should be apparent to one skilled in the art in the context of the above description. Also, included in the schematically represented circuits of FIGS. 1 and 3 are small unlabeled boxes, and these constitute terminals where external connections can be made to the circuitry of the control, and which can also be utilized to facilitate remote control options. For example, as illustrated by the boxes, remote controls could be located at the current level potentiometer of the current level selector 16, at the electrode current sensing means 14, at the steam output meter 82, at the humidistat 90, at the abnormal operation light 42, at the over-fill sensor 29, and at the external switch 66 including the power-on light 148.

It is to be understood that the invention is not confined to the particular construction and arrangement of components and circuits herein illustrated and described, but embraces all such modified forms thereof as come within the scope of the following claims.

We claim:

1. An electronic steam humidifier control for regulating the power input into a humidifier system including an electrode boiler having electrically controlled water fill and water drain valves, and in which electrode current generated from an AC source passes through and between electrodes submerged in water to produce steam, said control normally regulating the power input in accordance with a repetitive fill, boil, fill-on-drain cycle, said control comprising current sensing means for providing an analog signal proportional to the magnitude of electrode current passing through the water between the electrodes, and current control means including comparator network means for receiving said analog signal and for providing a plurality of digital output signals each having a high or low state depending upon the magnitude of the electrode current, and also including digital logic circuit means including a plurality of NAND gates and for receiving and processing said plurality of digital output signals for energizing the electrically controlled water fill valve to fill the boiler with water when the magnitude of the electrode current is less than a normal lower current limit, thereafter, when the boiler has filled with water to a level where the magnitude of the electrode current has increased to above a normal upper current limit, said circuit control means also for deenergizing the fill valve and allowing the water to boil, thereafter, when the water level in the boiler has decreased to where the magnitude of the electrode current has decreased to below an intermediate current limit, said circuit control means also for energizing the electrically controlled water drain valve and the water fill valve, the energized drain valve having a capacity greater than the fill valve so that water is drained from the boiler, thereafter, when the water level in the boiler has decreased to where the magnitude of the electrode current has decreased to below said normal lower current limit, said circuit control means also for deenergizing said water drain valve to end said cycle, and for maintaining said fill valve in an energized state to initiate repeating said fill, boil, fill-on-drain cycle.

2. A control as specified in claim 1 wherein said circuit control means further comprises fill driver means for energizing the electrically controlled water fill valve, and drain driver means for energizing the electrically controlled water drain valve, each of said driver means connected in circuit with said plurality of NAND gates.

3. A humidifier control as specified in claim 2 wherein said circuit control means further comprises minimum fill timer means connected in circuit with said plurality of NAND gates for energizing said fill driver means so that the fill valve is energized and water flows into the boiler for a predetermined minimum length of time after the drain valve has been deenergized at the end of the normal fill, boil, fill-on-drain cycle.

4. A control as specified in claim 2 wherein said circuit control means further comprises high water probes adapted for location in an upper portion of the boiler, and over-fill sensor means connected to said high water probes and connected in circuit with said plurality of NAND gates for deenergizing said fill driver means so that the fill valve is deenergized and flow of water into the boiler is interrupted when said high water probes are submerged in water, said over-fill sensor means also for allowing the water in the boiler to boil and become mineral enriched and, thereafter, for allowing said fill driver means to be reenergized after the water level in the boiler has dropped so that said high water probes are no longer submerged.

5. A control as specified in claim 4 wherein said over-fill sensor means includes delaying means for preventing said over-fill sensor means from deenergizing said fill driver means for a predetermined period of delay time after said high water probes are submerged in water so that said fill driver means is not deenergized in response to momentary splashing or momentary submersion of said high water probes.

6. A control as specified in claim 1 wherein one of said plurality of digital output signals provided by said comparator network means changes state if the magnitude of the electrode current exceeds a predetermined over-current limit greater than said normal upper limit, and wherein said circuit control means includes over-current timer means for initiating and selectively repeating an over-current mode of operation temporarily interrupting the fill, boil, fill-on-drain cycle of said control for a predetermined period of time when the magnitude of the electrode current exceeds said over-current limit, said over-current mode of operation including disconnecting the boiler electrodes from the AC power source, and energizing the drain valve to drain water from the boiler, said over current mode of operation repeating at the end of said predetermined period of time unless the magnitude of the electrode current has decreased below said over-current limit.

7. A control as specified in claim 1 wherein one of said plurality of digital output signals provided by said comparator network means changes state if the magnitude of the electrode current decreases below a predetermined under-current limit less than said normal lower limit, and wherein said circuit control means includes abnormal operation indicator means including an abnormal operation light which is illuminated when the magnitude of the electrode current decreases below said under-current limit.

8. A control as specified in claim 1 wherein said logic circuit means includes flip-flop means having an input connected to at least one of said plurality of digital output signals, and connected in circuit with said NAND gates for preventing the drain valve from being energized during the fill portion of the fill, boil, fill-on-drain cycle.

9. A control as specified in claim 1 wherein said circuit control means includes low current indicator means for indicating when the electrode current has a magnitude less than said normal lower limit, and upper current indicator means for indicating when the electrode current has a magnitude greater than said normal upper limit.

10. A control as specified in claim 1 wherein said comparator network means includes a plurality of comparators each having an output for providing one of said plurality of digital output signals, and each having a pair of inputs, each comparator having one input connected to said current sensing means for receiving said analog signal; and wherein said circuit control means further comprises current level means for providing an adjustable reference voltage, and voltage divider means for providing scaled voltages proportional to said reference voltage, said reference and scaled voltages each respectively connected to the other input not receiving said analog signal of one of said comparators, said adjustable reference voltage and said scaled voltages establishing the magnitude of the normal lower, intermediate, and normal upper current limits, so that a different one of said digital output signals changes state each time the electrode current exceeds a corresponding different one of said current limits.

11. A control as specified in claim 10 wherein one of said plurality of digital outputs signals provided by said comparator network means changes state if the magnitude of the electrode current exceeds a predetermined over-current limit greater than said normal upper limit, wherein said circuit control means further comprises fill driver means for energizing the electrically controlled water fill valve, drain driver means for energizing the electrically controlled water drain valve, and power relay driver means controlling the energization of the boiler electrodes by the AC source, each of said driver means connected in circuit with said plurality of NAND gates, and also further comprises over-current timer means for initiating and selectively repeating an over-current mode of operation temporarily interrupting the fill, boil, fill-on-drain cycle of said control for a predetermined period of time when the electrode current exceeds said over-current limit, said over-current mode of operation including energizing said power relay driver means to disconnect the boiler electrodes from the AC power source, and energizing said drain driver means to energize the drain valve to drain water from the boiler, said over-current mode of operation repeating at the end of said predetermined period of time unless the electrode current had decreased below said over-current limit, and wherein said adjustable reference voltage establishes the magnitude of said over-current limit.

12. A control as specified in claim 10 wherein one of said plurality of digital output signals provided by said network comparator means changes state if the magnitude of the electrode current decreases below a predetermined under-current limit less than said normal lower limit, wherein said circuit control means includes abnormal operation indicator means including an abnormal operation light which is illuminated when the electrode current decreases below said under-current limit, and wherein one of said scaled voltages establishes said under-current limit.

13. A control as specified in claim 10 wherein said logic circuit means further comprises flip-flop means, including two flip-flops each having an input connected to a different one of said plurality of digital output signals, and connected in circuit with said NAND gates for preventing the drain valve from being energized during the fill portion of the fill, boil, fill-on-drain cycle.

14. An electronic steam humidifier control for regulating the power input into a humidifier system including an electrode boiler having electrically controlled water fill and water drain valves, and in which electrode current generated from an AC source passes through and between electrodes submerged in water to produce steam, said control normally regulating the power input in accordance with a repetitive fill, boil, drain cycle, said control comprising current sensing means for providing an analog signal proportional to the magnitude of electrode current passing through the water between the electrodes, and circuit control means including comparator network means for receiving said analog signal and for providing a plurality of digital output signals each having a high or low state depending upon the magnitude of the electrode current, and also including logic circuit means including a plurality of NAND gates and for receiving and processing said plurality of digital output signals for energizing the electrically controlled water fill valve to fill the boiler with water when the magnitude of the electrode current is less than a normal lower current limit, thereafter, when the boiler has filled with water to a level where the magnitude of the electrode current has increased to above a normal upper current limit, said circuit control means also for deenergizing the fill valve and allowing the water to boil, thereafter, when the water level in the boiler has decreased to where the magnitude of the electrode current has decreased to below an intermediate current limit, said circuit control means also for energizing the electrically controlled water drain valve so that water is drained from the boiler, thereafter, when the water level in the boiler has decreased to where the magnitude of the electrode current has decreased to below said normal lower current limit, said circuit control means also for deenergizing said water drain valve to end said cycle, and for energizing said fill valve to initiate repeating said fill, boil, drain cycle.

15. A control as specified in claim 14 wherein said circuit control means further comprises fill driver means for energizing the electrically controlled water fill valve, and drain driver means for energizing the electrically controlled water drain valve, each of said driver means connected in circuit with said plurality of NAND gates.

16. A humidifier control as specified in claim 15 wherein said circuit control means further comprises minimum fill timer means connected in circuit with said plurality of NAND gates for energizing said fill driver means so that the fill valve is energized and water flows into the boiler for a predetermined minimum length of time after the drain valve has been deenergized at the end of the normal fill, boil, drain cycle.

17. A control as specified in claim 15 wherein said circuit control means further comprises high water probes adapted for location in an upper portion of the boiler, and over-fill sensor means connected to said high water probes and connected in circuit with said plurality of NAND gates for deenergizing said fill driver means so that the fill valve is deenergized and flow of water into the boiler is interrupted when said high water probes are submerged in water, said over-fill sensor means also for allowing the water in the boiler to boil and become mineral enriched and, thereafter, for allowing said fill driver means to be reenergized after the water level in the boiler has dropped so that said high water probes are no longer submerged.

18. A control as specified in claim 17 wherein said over-fill sensor means includes delaying means for preventing said over-fill sensor means from deenergizing said fill driver means for a predetermined period of delay time after said high water probes are submerged in water so that said fill driver means is not deenergized in response to momentary splashing or momentary submersion of said high water probes.

19. A control as specified in claim 14 wherein one of said plurality of digital output signals provided by said comparator network means changes state if the magnitude of the electrode current exceeds a predetermined over-current limit greater than said normal upper limit, and wherein said circuit control means includes over-current timer means for initiating and selectively repeating an over-current mode of operation temporarily interrupting the fill, boil, drain cycle of said control for a predetermined period of time when the magnitude of the electrode current exceeds said over-current limit, said over-current mode of operation including disconnecting the boiler electrodes from the AC power source, and energizing the drain valve to drain water from the boiler, said over current mode of operation repeating at the end of said predetermined period of time unless the magnitude of the electrode current has decreased below said over-current limit.

20. A control as specified in claim 14 wherein one of said plurality of digital output signals provided by said comparator network means changes state if the magnitude of the electrode current decreases below a predetermined under-current limit less than said normal lower limit, and wherein said circuit control means includes abnormal operation indicator means including an abnormal operation light which is illuminated when the magnitude of the electrode current decreases below said under-current limit.

21. A control as specified in claim 14 wherein said logic circuit means includes flip-flop means having an input connected to at least one of said plurality of digital output signals, and connected in circuit with said NAND gates for preventing the drain valve from being energized during the fill portion of the fill, boil, drain cycle.

22. A control as specified in claim 14 wherein said circuit control means includes low current indicator means for indicating when the electrode current has a magnitude less than said normal lower current limit, and upper current indicator means for indicating when the electrode current has a magnitude greater than said normal upper current limit.

23. A control as specified in claim 14 wherein said comparator network means includes a plurality of comparators each having an output for providing one of said plurality of digital output signals, and each having a pair of inputs, each comparator having one input connected to said current sensing means for receiving said analog signal; and wherein said circuit control means further comprises current level means for providing an adjustable reference voltage, and voltage divider means for providing scaled voltages proportional to said reference voltage, said reference and scaled voltages each respectively connected to the other input not receiving said analog signal of one of said comparators, said adjustable reference voltage and said scaled voltages establishing the magnitude of the normal lower, intermediate, and normal upper current limits, so that a different one of said digital output signals changes state each time the electrode current exceeds a corresponding different one of said current limits.

24. A control as specified in claim 23;

wherein one of said plurality of digital output signals provided by said comparator network means changes state if the magnitude of the electrode current exceeds a predetermined over-current limit greater than said normal upper limit, wherein said circuit control means further comprises fill driver means for energizing the electrically controlled water fill valve, drain driver means for energizing the electrically controlled water drain valve, and power relay driver means controlling the energization of the boiler electrodes by the AC source, each of said driver means connected in circuit with said plurality of NAND gates, and also further comprises over-current timer means for initiating and selectively repeating an over-current mode of operation temporarily interrupting the fill, boil, drain cycle of said control for a predetermined period of time when the electrode current exceeds said over-current limit, said over-current mode of operation including energizing said power relay driver means to disconnect the boiler electrodes from the AC power source, and energizing said drain driver means to energize the drain valve to drain water from the boiler, said over-current mode of operation repeating at the end of said predetermined period of time unless the electrode current had decreased below said over-current limit.

25. A control as specified in claim 23 wherein one of said plurality of digital output signals provided by said network comparator means changes state if the magnitude of the electrode current decreases below a predetermined under-current limit less than said normal lower limit, wherein said circuit control means includes abnormal operation indicator means including an abnormal operation light which is illuminated when the electrode current decreases below said under-current limit, and wherein one of said scaled voltages establishes said under-current limit.

26. A control as specified in claim 23 wherein said logic circuit means further comprises flip-flop means, including two flip-flops each having an input connected to a different one of said plurality of digital output signals, and connected in circuit with said NAND gates for preventing the drain valve from being energized during the fill portion of the fill, boil, drain cycle.

27. An electronic steam humidifier system comprising an electrode boiler having electrodes and electrically controlled water fill and water drain valves, and in which electrode current generated from an AC source passes through and between said electrodes when submerged in water to produce steam, a humidistat for selectively interrupting the electrode current generated from the AC source, and a control normally regulating the electrode current, subject to said humidistat, in accordance with a repetitive fill, boil, drain cycle, said control comprising current sensing means for providing an analog signal proportional to the magnitude of electrode current passing through the water between said electrodes, and circuit control means including comparator network means for receiving said analog signal and for providing a plurality of digital output signals each having a high or low state depending upon the magnitude of the electrode current, and also including logic circuit means including a plurality of NAND gates and for receiving and processing said plurality of digital output signals for energizing said electrically controlled water fill valve to fill said boiler with water when the magnitude of the electrode current is less than a normal lower current limit, thereafter, when said boiler has filled with water to a level where the magnitude of the electrode current has increased to above a normal upper current limit, said circuit control means also for deenergizing said fill valve and allowing the water to boil, thereafter, when the water level in the boiler has decreased to where the magnitude of the electrode current has decreased to below an intermediate current limit, said circuit control means also for energizing said electrically controlled water drain valve so that water is drained from said boiler, thereafter, when the water level in the boiler has decreased to where the magnitude of the electrode current had decreased to below said normal lower current limit, said circuit control means also for deenergizing said water drain valve to end said cycle, and for energizing said fill valve to initiate repeating said fill, boil, drain cycle.

28. A humidifier system as specified in claim 27 wherein said fill valve is energized when said drain valve is energized, and said drain valve has a capacity greater than said fill valve so that water is drained from said boiler when said drain and fill valves are energized, whereby said electrode current is normally regulated in accordance with a repetitive fill, boil, fill-on-drain cycle.

29. A humidifier system as specified in claim 28 wherein said circuit control means further comprises external switch means for allowing an operator to select one of a normal cycle mode, an off cycle mode wherein said boiler electrodes are disconnected from the AC power source and said fill and drain valves are deenergized, and an external drain mode wherein said boiler electrodes are disconnected from the AC power source, and said fill and drain valves are energized in order to drain water from the boiler.

30. A method for regulating the power input into a humidifier system including a boiler in which electrode current generated from an AC source passes through water between electrodes to produce steam, said method normally regulating the power input in accordance with a repetitive fill, boil, fill-on-drain cycle, said method comprising the repetitive steps of continually sensing the magnitude of electrode current passing through the water between the electrodes, energizing an electrically controlled water fill valve to fill the boiler with water when the electrode current is less than a normal lower current limit, thereafter, when the boiler has filled with water to a level where electrode current has increased to above a normal upper limit, deenergizing the fill valve and allowing the water to boil, thereafter, when the water level in the boiler has decreased to where the electrode current had decreased to below an intermediate limit, energizing an electrically controlled water drain valve and the water fill valve, said energized drain valve having a capacity greater than said fill valve so that water is drained frome the boiler, thereafter, when the water level of the boiler has decreased to where the electrode current had decreased to below a normal lower limit, deenergizing said water drain valve, and maintaining said fill valve in an energized state to initiate repeating said repetitive steps to provide said repetitive fill, boil, fill-on-drain cycle.

* * * * *